US006041997A

United States Patent [19]

Jensen

[11] Patent Number: 6,041,997

[45] Date of Patent: Mar. 28, 2000

[54] PAPERBOARD CLAMSHELL CONSTRUCTION

[75] Inventor: Kurt Jensen, Lebanon, Ohio

[73] Assignee: International Paper Company, Purchase, N.Y.

[21] Appl. No.: 09/364,941

[22] Filed: Jul. 30, 1999

[51] Int. Cl.[7] ..... B65D 5/42

[52] U.S. Cl. ..... 229/114; 206/459.5; 229/902

[58] Field of Search ..... 229/114, 902, 229/906; 206/459.5; 40/312

[56] References Cited

U.S. PATENT DOCUMENTS

| | | | |
|---|---|---|---|
| Re. 33,979 | 6/1992 | Cortopassi | 229/902 |
| 2,180,808 | 11/1939 | Jacobstein . | |
| 3,071,882 | 1/1963 | Eisman et al. | 40/312 |
| 3,099,381 | 7/1963 | Meyers . | |
| 3,205,603 | 9/1965 | Brumley . | |
| 3,207,411 | 9/1965 | Farquhar | 206/459.5 |
| 3,389,850 | 6/1968 | Rockefeller . | |
| 3,524,782 | 8/1970 | Buske . | |
| 3,648,833 | 3/1972 | Dash . | |
| 4,324,823 | 4/1982 | Ray . | |
| 4,472,896 | 9/1984 | Brauner . | |
| 4,548,352 | 10/1985 | Capo . | |
| 4,872,555 | 10/1989 | Shodrach . | |
| 5,007,578 | 4/1991 | Simone | 206/459.5 |
| 5,662,265 | 9/1997 | Jensen . | |
| 5,690,273 | 11/1997 | Jensen . | |
| 5,697,549 | 12/1997 | Yocum | 206/459.5 |
| 5,826,781 | 10/1998 | Jensen | 229/114 |

*Primary Examiner*—Gary E. Elkins
*Attorney, Agent, or Firm*—Ralph J. Skinkiss

[57] ABSTRACT

A clamshell type container is formed from a unitary blank (10) of paperboard, the top or crown of the container including two side wall panels (32) which extend slantingly downwardly and whose free edges extend beneath the upper edges of the lower container half side walls. The crown has a front wall formed of two panels (40, 48) folded together so as to define a dual layer front wall. The outer panel (40) of the dual layer front wall is provided with spaced apart perforated lines (46) to define a tear strip (44). The inner panel (48) of the dual layer front wall is provided with indicia to show the winning of a prize upon tearing off of the tear strip. Alternatively, the normally hidden inner surface of the tear strip may be provided with indicia. Either of the downwardly sloping side wall panels (32) of the crown or top may, alternatively, be provided with this tear strip and indicia construction. As a further variant, the auxiliary indicia panel (48) may be folded over the crown front panel (40) so that the auxiliary indicia panel (48) is on the outside of the dual layer (40, 48) crown front wall, instead of on the inside.

9 Claims, 3 Drawing Sheets

PAPERBOARD CLAMSHELL CONSTRUCTION

BACKGROUND OF THE INVENTION

This invention relates to a container and more particularly to a clamshell type container fashioned from a unitary blank of paperboard. Such containers display wide use in the fast food area where, typically, a hamburger sandwich is placed into the lower or tray portion of the clamshell container, the container crown or upper portion closed, and the container then served to a consumer. The container is usually releasably latched shut and is thereafter unlatched by the consumer to gain access to the product.

Prize coupons frequently make use of an applied or removable label. The label is typically made of two plies. When the plies are separated, a printed message on one of them reveals whether the consumer or purchaser wins a prize. The practice of this invention eliminates the need for such a separate and distinct dual ply label.

SUMMARY OF THE INVENTION

According to the practice of this invention, the upper or crown front wall of a paperboard clamshell container is fashioned of two plies or panels. These panels are folded together to define an upper front panel of two paperboard layers. The outermost of these two layers includes a tab, the tab defined by two perforated lines running from top to bottom of the upper top front container wall. Either before or after consumption of a food product served in the clamshell container, the user pulls away the tab between the two perforated lines, to thereby expose a message on the surface of the inner of the two layers which define the upper front wall of the container. Alternatively, the rear or inner surface of this pull tab may carry a message indicating the winning of a prize, for example.

DETAILED DESCRIPTION OF THE INVENTION

Figure 1:
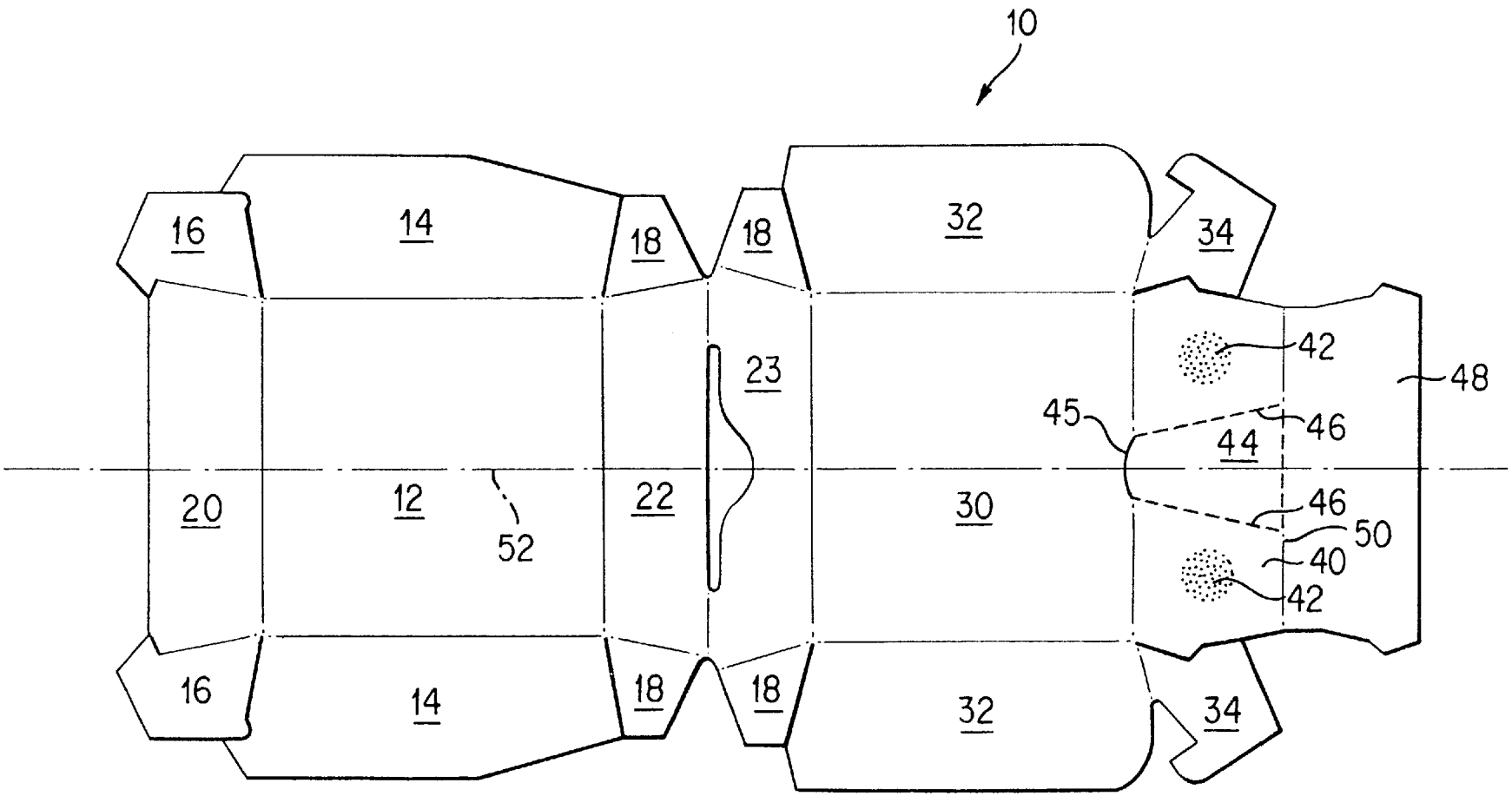
FIG. 1 is a plan view of a unitary blank of paperboard or other stiff, resilient, and foldable sheet material employed for forming the clamshell container of this invention.

Referring now to FIG. 1 of the drawings, a unitary blank of stiff, resilient, and foldable sheet material such as paperboard is designated as 10. In FIG. 1, fold lines are denoted by relatively light solid lines, while cut lines on the blank are denoted by relatively thick or heavy solid lines. The blank includes a bottom forming panel 12 whose periphery is defined by the indicated score lines, the latter permitting folding of bottom side wall forming panels 14, glue panels 16 and 18. The blank also includes a bottom front wall forming panel 20 and a rear bottom wall forming panel 22.

Panel 23, being a rear top or crown wall panel, is foldably secured as indicated to panel 22. The top or crown forming portion of the blank includes central top or crown panel 30, top side wall forming panels 32, and latching panels 34. The right-hand portion of panel 30 is foldably secured to a panel 40, the latter provided with adhesive spots or areas 42. Panel 40 is also provided with a tear strip or tear tab 44 defined as that portion of panel 40 between slanted perforated lines 46. The left end of tear strip 44 may be rounded as indicated at 45 and extends slightly beyond the indicated fold line between panels 30 and 40. Panel 40 is termed an outer or top panel front wall. An inner top panel front wall is designated as 48 and is secured to panel 40 by means of fold line 50. The indicia may be carried on panel 48, or alternatively, it may be carried by tear tab 44. It is seen that panels 40 and 48 are mirror symmetrical about fold line 50. Panels 14, 20, 22, 23, 32, and 40 may be termed peripheral panels since they are located on the periphery of respective panels 12 and 30. Panel 48 is termed an auxiliary indicia panel. It is not required for the operation of a conventional paperboard clamshell container, and is hence auxiliary, and cooperates (as will be described) with indicia carried either by itself or one of the other top peripheral panels to indicate a prize.

It will also be observed that blank 10 is mirror symmetrical about its longitudinal axis 52. The elongated opening between panels 22 and 23 is to inhibit buckling of the container when opened. Except for tear tab 44, perforated lines 46, adhesive areas 42, and auxiliary indicia panel 48, blank 10 is substantially conventional.

Figure 2:
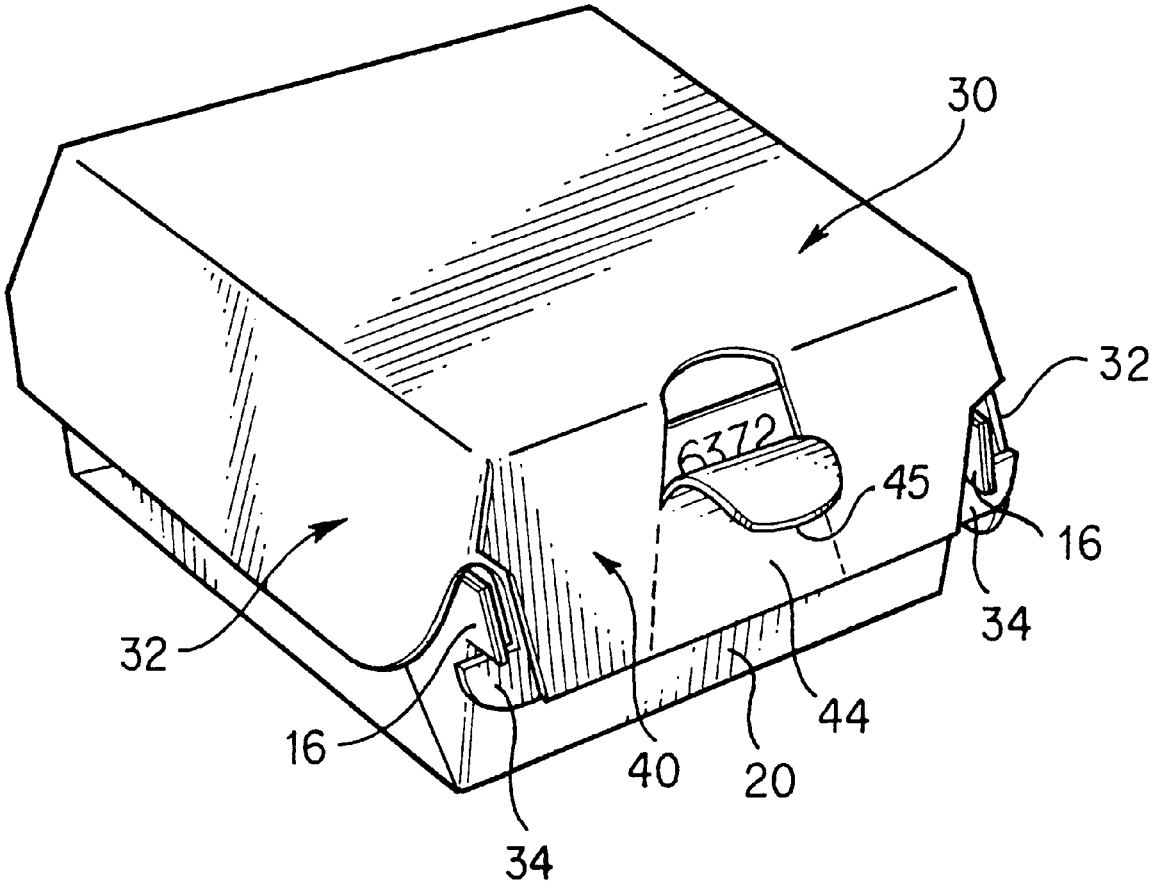
FIG. 2 is a perspective view of a clamshell type container fashioned in accordance with this invention shown its assembled or erected condition, the top or crown of the container being shown as closed, and a pull tab partially torn away to expose indicia.

Referring now to FIG. 2, the blank has been glued and erected. Its top or crown forming panels have been folded about the fold line connecting the two rear wall defining panels 22 and 23 (see FIG. 1). The container exhibits a top front wall of double thickness or double layers of the paperboard, panel 48 being folded about fold line 50 and glued on panel 40, underneath the latter, by adhesive areas 42. One zone or area of panel 48 is thus directly opposite to tear strip or tab 44. This zone or area of panel 48, on the hidden (inner) part of tear strip 44 itself, can carry indicia to inform the user as to whether a prize is associated with a particular container.

In use, the user pulls projecting tab tip 45, rips down tear strip 44 along perforated lines 46, to thereby expose to view the indicia provided area of panel 48. At illustrated in FIG. 2, such typical indicia might be "6372" on panel 48. As noted above, the indicia may be instead be carried on the hidden or inner surface of tear tab 45.

Figure 3:
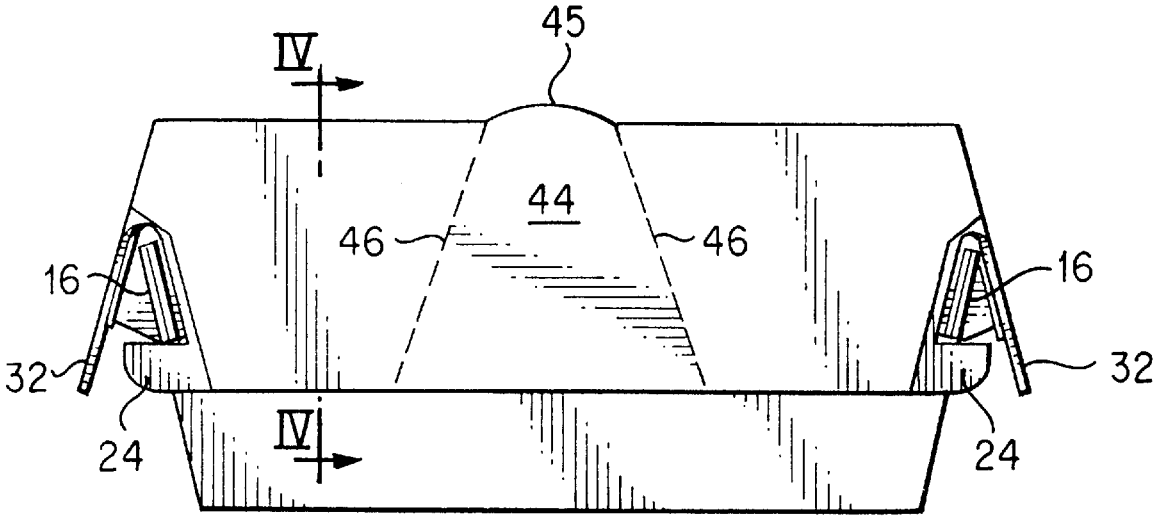
FIG. 3 is a side elevation of the closed container of this invention, looking towards the container front, and showing the slight projection of the top of the pull tab.
Figure 4:
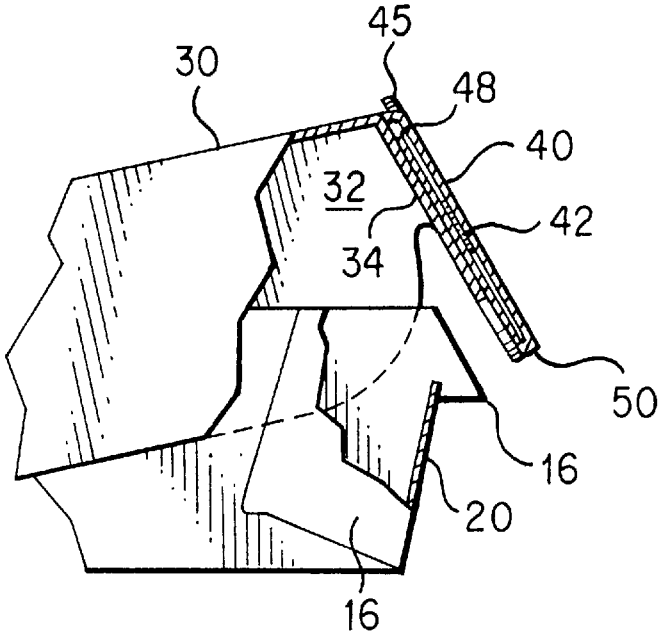
FIG. 4 is a view taken along section IV—IV of FIG. 3, but with the front part of the top or crown of the container unlatched and slightly lifted.

FIGS. 3 and 4 further illustrate the construction. The crown front and two side wall panels 40 and 32 each (conventionally) extend below their counterparts on the lower or tray part of the container, namely, that part which contains bottom panel 12. To open the crown and gain access to food in the container, latches 16 and 34 are disengaged, as is conventional.

The manner of erecting the container from the blank is known and forms no part of this invention.

It is to be noted that the double layer construction defined by adding auxiliary indicia panel 48 to front panel 40, and providing panel 40 with a tear tab 44 and glue areas 42, could also be carried out with either of the two crown side panels 32. This is seen by reference to FIG. 2, wherein it is readily imagined that tab 44 could be moved to either crown side panel 32, and a panel similar to auxiliary panel 48 added to the free edge (opposite the fold line with panel 30) of either side panel 32. Top wall (or crown) side panels 32, and container front panel 40, are termed crown peripheral panels. Rear wall panel 23 is also, literally, a crown peripheral panel but is instead, in this description, termed a crown rear wall panel. In a similar manner, bottom front wall panel 20, bottom side walls 14, and bottom rear wall 22, may be termed bottom peripheral panels.

Panel 48 is illustrated as bent underneath panel 40, so that panel 40 is on the outer surface of the clamshell container, most remote from the clamshell interior. This is the preferred mode. However, it is seen that panel 48 could be provided with perforated lines to define a tab of tear strip, similar to perforated lines 46. Such a tab may also be provided with a rounded, finger tip engaging end, similar to end 45. In this case, panel 48 would be folded so as to be located on the outer surface of the crown front wall. In this variation, as well as the embodiment illustrated, the consumer again pulls down a tab or tear strip to determine whether a prize was won. Again, the indicia might be placed on the interior surface of the tab, or on panel 40.

What is claimed is:

1. A unitary blank of paperboard, said blank including a plurality of panels defined by fold lines and cut lines, said panels including a top wall panel and a bottom wall panel, said top wall panel having a plurality of peripheral panels foldably secured thereto, said bottom wall panel having a plurality of peripheral panels foldably secured thereto, an auxiliary indicia panel foldably secured to an edge of one of said top wall peripheral panels, one of said top wall peripheral panels and auxiliary panel having a pair of perforated tear lines extending across it, that area between said perforated lines defining a tear tab, whereby a normally hidden area of one of said tear tab and is exposed upon ripping of said tear tab, to thereby indicate a prize.

2. The blank of claim 1 wherein said tear tab has one end terminating at a fold line and having an opposite end which is rounded.

3. The blank of claim 1 wherein one of said top wall peripheral panels is a front panel, and wherein said auxiliary indicia panel is secured to said front panel.

4. The blank of claim 1 wherein said top wall panel is foldably connected to said auxiliary indicia panel.

5. A clamshell type container including a plurality of panels defined by fold lines and cut lines, said panels including a top wall panel and a bottom wall panel, said bottom wall panel having peripheral panels foldably secured thereto, said top wall panel having peripheral panels foldably secured thereto, an auxiliary indicia panel foldably connected to one of said top peripheral panels, one of said auxiliary indicia panel and said top peripheral panels having a pair of spaced apart perforated lines spanning it to thereby form a tear tab, a fold line connecting said auxiliary indicia panel to one of said top wall peripheral panels to thereby form a double layer wall, whereby a normally hidden area of said auxiliary indicia panel or said top peripheral panel is exposed upon ripping of said tear strip, to thereby indicate a prize.

6. The container of claim 5 wherein said tear tab has two ends, one said end terminating at a fold line and said other end terminating beyond a fold line.

7. The container of claim 5 wherein one of said top wall peripheral panels is a top front wall panel, said indicia panel being foldably secured to said top wall front panel.

8. The container of claim 5 wherein said auxiliary indicia panel is located interiorly of said panel to which it is foldably attached.

9. The container of claim 5 wherein said container is formed from a unitary blank of paperboard.

* * * * *